United States Patent [19]

Dunn, Jr.

[11] 3,960,203

[45] June 1, 1976

[54] FLUIDIZED BED COOLER

[75] Inventor: Wendell E. Dunn, Jr., Sydney, Australia

[73] Assignee: Titanium Technology N.V., Curacao, Netherlands Antilles

[22] Filed: Apr. 9, 1973

[21] Appl. No.: 349,255

Related U.S. Application Data

[63] Continuation-in-part of Ser. No. 138,461, April 29, 1971, abandoned.

[52] U.S. Cl. ..... 165/1; 34/20; 122/28; 165/104 R; 432/85

[51] Int. Cl.[2] ..... F28D 13/00

[58] Field of Search ..... 165/1, 104; 23/288.31; 122/28; 34/20; 432/85

[56] References Cited

UNITED STATES PATENTS

| | | | |
|---|---|---|---|
| 972,418 | 10/1910 | Vautin | 122/28 |
| 1,001,290 | 8/1911 | McKee | 122/28 |
| 1,597,718 | 8/1926 | Bringhenti | 122/28 |
| 1,614,387 | 1/1927 | Pereda | 122/28 |
| 1,738,890 | 12/1929 | Goodrich | 122/28 |
| 3,447,338 | 6/1969 | Smith, Jr. | 165/104 |

*Primary Examiner*—Charles J. Myhre
*Assistant Examiner*—Daniel J. O'Connor

[57] ABSTRACT

In the process of beneficiating ilmenite ore by the chloride method the improvement wherein the beneficiate is cooled without oxidation hot finely divided particles comprising using the principle of film boiling to effect volatilization of a non-oxidizing liquid to both fluidize and cool the hot particles.

5 Claims, 2 Drawing Figures

INVENTOR
BY Wendell E. Dunn, Jr.
Samuel V. Abramo
ATTORNEY

FLUIDIZED BED COOLER

CROSS REFERENCE TO PRIOR APPLICATION

This application is a continuation-in-part of my copending application Ser. No. 138,461, filed Apr. 29, 1971 now abandoned.

FIELD OF THE INVENTION

This invention relates to a fluidized bed cooler capable of effecting fluidization and cooling of finely divided particles introduced at high temperatures without causing oxidization of those particles.

BACKGROUND OF THE INVENTION

In many cases it is desirable to cool very hot particles without altering their chemical composition by oxidation as would occur if an ordinary fluidized bed were employed using a stream of air for fluidization and cooling. In such situations inert gas streams have been used as well as gas streams having reducing properties such as nitrogen and carbon monoxide respectively. Employing such gas streams is expensive since the gas must be recovered, cleaned and cooled before it is recirculated through the fluidized bed. Many improvements have been suggested for making such apparatus more economical as for instance by redesigning the distribution chamber and orifices below the fluidized bed. A considerable number of improvements have also been suggested for the recovery, cooling and recirculation of the cooling gases.

It is an object of this invention to provide simple means for cooling hot finely divided particles in a fluidized bed without effecting oxidation of the particles and more particularly to provide a means for cooling hot finely divided beneficiated and partially beneficiated ilmenite ore.

SUMMARY OF THE INVENTION

This invention is directed to a process for cooling a bed of hot finely divided partially beneficiated titaniferous ore wherein the improvement comprises introducing into a bed of hot ore a stream of a liquid having a boiling point at least 100°C. below the temperature of the ore and at a rate wherein volatilization of the liquid maintains the bed of ore in a fluidized state. The partially beneficiated ore is useful as a starting material for titanium dioxide pigments.

According to the present invention, the thermal expansion of a volatile liquid to its gaseous state is utilized to fluidize the bed. Simultaneously, the heat of vaporization of such liquid is employed to absorb heat from the bed. In most instances occurring in industry, the particles are at high temperatures due to previous processing and can be introduced into the bed at temperatures high enough to volatilize the liquid introduced into the bed and because of film boiling without wetting the surface of the particles. If this is not the case, the particles will become wetted as by nucleate boiling, will agglomerate and more conventional means will have to be used. However, in most cases, the particles desired to be cooled are hot enough to evaporate substantial quantities of water at the maximum evaporation rate without being cooled on their surfaces to such an extent that their surfaces become wetted. Because of the very large difference in temperature between the particles and the water, boiling takes place in the film-boiling regime and heat is removed through a vapor blanketing film by conduction and radiation.

In this invention, preferably the ore being cooled has a temperature of 200° to 1100°C., and most preferred, 350° to 1050°C. The liquid preferably is water, but it can be any non-oxidizing liquid depending upon the temperature of the ore.

BRIEF DESCRIPTION OF THE DRAWINGS

In the practice of this invention, many embodiments can be envisaged some of which are described in detail as follows with reference to the drawings:

In its simplest form as shown in FIG. 1, the apparatus can consist of a tank 1 into which the very hot, finely divided fluidized particulate material 7 flows from a feed inlet tube 2. Immersed in this material is a pipe 3 by which the finely divided particulate material 6 is charged to the tank having a plurality of perforations 5. The non-oxidizing fluid, e.g. water, is passed through the perforations into the reactor. As the water contacts the hot surfaces of the particles, it vaporizes into steam which serves to fluidize the bed and cool the material in the bed at the same time. As the material is cooled, it is withdrawn continuously through a discharge outlet 4, and the steam which developed passes upwardly and out of the vessel through an outlet tube 8.

Figure 1:
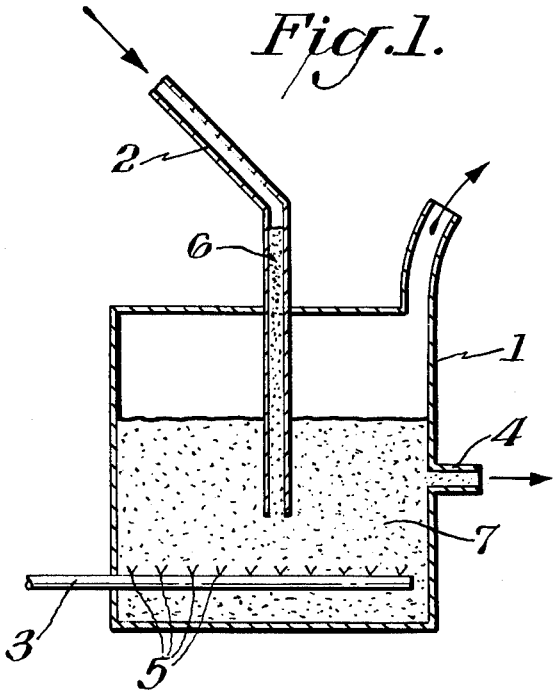
Figure 2:
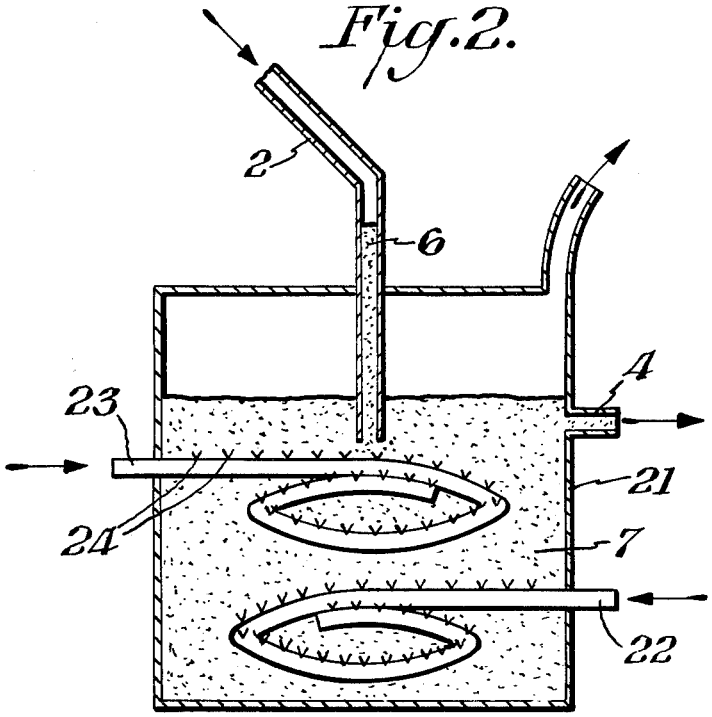

Depending on the heat of the material and the volatility of the liquid, it may be necessary to initially fluidize the bed in a conventional manner before introducing the liquid. Accordingly, in FIG. 2, there is shown another embodiment of the invention in which the tank 21 has disposed along its bottom portion of the tank through a plurality of orifices 24 in the upper surface of the pipe. Similarly disposed in a second pipe 23 with a plurality of orifices 24 through which a volatile liquid can be injected into the tank. When a hot, finely divided material is introduced into the tank, the inert gas is supplied through the orifices of pipe 22 in sufficient volume to fluidize the bed. Once the bed is fluidized, the volatile liquid is supplied through pipe 23, and as it comes into contact with the fluidized particles, the evolution of its gas will maintain fluidization and the flow of inert gas supply can be shut-off or reduced.

Many other embodiments will occur to those skilled in the art with various modifications, particularly in the manner of introducing the liquid into the fluidized bed. Depending on the temperature and chemical nature of the finely divided solids, various liquids, such as volatile organic chemicals can be used instead of water. These will vary depending on the physical and chemical characteristics of the material to be cooled and the sophistication of the technician devising the system. However, for simplicity in describing the invention, the following simple example is set forth as follows:

In a steel vessel having a diameter of 2.5 feet and a height of 7 feet with an outlet at the 3-foot level, there is placed a 2-inch steel pipe formed into a circle with an outside diameter of 30 inches within the tank. Thirty pounds per minute of partially beneficiated ilmenite having a particle size of −20 and +20 and +220 mesh and at a temperature of 1000°C. is then flowed into the tank. Then water at a temperature of 70°C. is introduced into the pipe at a rate of 0.57 gallons per minute. As the water exits from the orifices in the pipe, the heat of the ore vaporizes the water instantly to steam which fluidizes the bed as it expands and rises to escape. Ore is continuously removed from the bed at the same rate of 30 pounds per minute and leaves the bed at a temperature of approximately 350°C.

Partially beneficiated ilmenite ore can be produced by passing chlorine gas through a mixture of finely divided ilmenite ore containing under reducing conditions at a temperature of about 900° to 1050°C. as described in U.S. Pat. No. 3,699,206.

The foregoing detailed description has been given for clarity of understanding only and no unnecessary limitations are to be understood therefrom. The invention is not limited to the exact details shown and described for obvious modifications will occur to those skilled in the art.

The embodiments of the invention in which an exclusive property or privilege is claimed are defined as follows:

1. A process for cooling to a temperature of 200°C., a fluidized bed of finely divided partially beneficiated titaniferous ore heated to a temperature in the range of 350° to 1100°C., in a gas-solids reactor, comprising (a) injecting into the bed of ore a stream of liquid having a boiling point at least 100°C. below the temperature of the bed of ore whereby volatilization of the stream of liquid maintains the bed of ore in a fluidized state and (b) removing said volatilized liquid from the gas-solids reactor.

2. The process of claim 1 wherein the temperature of the bed of ore is in the range of 200° to 1100°C. and the liquid is water.

3. The process of claim 1 wherein the temperature of the bed of ore is in the range of 350° to 1100°C. and the liquid is water.

4. The process of claim 1 utilizing film boiling to provide fluidization of the bed of ore heated in the range of 500° to 1000°C. comprising continuously introducing a stream of water into the bed of ore, continuously removing the stream produced and continuously removing a stream of cooled ore from the bed.

5. The process of claim 1 comprising introducing into the bed a stream of liquid having a boiling point such that vaporization of the liquid takes place through a blanketing film of the vaporized liquid.

* * * * *